US005771031A

United States Patent [19]

Kinoshita et al.

[11] Patent Number: 5,771,031

[45] Date of Patent: Jun. 23, 1998

[54] FLAT-PANEL DISPLAY DEVICE AND DRIVING METHOD OF THE SAME

[75] Inventors: Kohei Kinoshita, Hyogo-ken; Tooru Arai, Yokohama; Kan Shimizu, Urawa, all of Japan

[73] Assignee: Kabushiki Kaisha Toshiba, Kawasaki, Japan

[21] Appl. No.: 548,615

[22] Filed: Oct. 26, 1995

[30] Foreign Application Priority Data

Oct. 26, 1994 [JP] Japan ..... 6-262122

[51] Int. Cl.[6] ..... G09G 3/36

[52] U.S. Cl. ..... 345/98; 345/100; 345/196; 345/202; 345/203

[58] Field of Search ..... 345/98, 100, 196, 345/202, 203

[56] References Cited

U.S. PATENT DOCUMENTS 5,097,257 3/1992 Clough et al. ..... 345/196
5,192,945 3/1993 Kusada ..... 345/100

*Primary Examiner*—Richard Hjerpe
*Assistant Examiner*—Juliana S. Kim
*Attorney, Agent, or Firm*—Cushman Darby & Cushman IP Group of Pillsbury Madison & Sutro LLP

[57] ABSTRACT

A flat-panel display device includes a display panel having a plurality of pixels arrayed in a matrix, the pixels in each row forming one horizontal pixel array, first to eighth driver sections arranged in series to divide pixels in each horizontal pixel array into eight pixel blocks, for driving the pixel blocks, respectively, first and second data supply buses each connected to at least one of the driver sections, and a liquid crystal controller for distributing pixel data sequentially supplied from outside to the first and second data supply buses. In particular, the liquid crystal controller includes a data distributing circuit having a plurality of memories each of which stores items of pixel data for one pixel block and is capable of reading from one area while writing to another area, a total memory capacity of the memories being smaller than a memory capacity required for storing all items of pixel data for one horizontal pixel array, and a sequence controller for performing a control of dividing pixel data items sequentially supplied from outside into pixel-data blocks each consisting of the same number of pixel data items, equivalent to the number of pixels forming one pixel block, sequentially writing two pixel-data blocks in two memories, reading two pixel-data blocks stored in the two memories in parallel while writing is performed, and supplying the two pixel-data blocks to corresponding ones of the first and second data supply buses.

20 Claims, 8 Drawing Sheets

FLAT-PANEL DISPLAY DEVICE AND DRIVING METHOD OF THE SAME

BACKGROUND OF THE INVENTION

1. Field of the Invention

The present invention generally relates to a flat-panel display device in which a plurality of pixels are arrayed in a matrix, and a driving method of the display device 2. Description of the Related Art In recent years, apparatuses such as a personal computer, a word processor, a television, and a video projector employ flat-panel displays represented by a Liquid Crystal Display (LCD), because of its characteristics such as thin, light and low power consumption. Particularly, active matrix LCDs are intensively researched and developed since an excellent display image can be obtained which has no closstalk between adjacent pixels. A typical active matrix LCD comprises a display panel in which a plurality of pixels are arrayed in a matrix and in which pixels of each row constitute a horizontal pixel array, and a signal line driving circuit for driving a plurality of signal lines to control light transmittance of pixels of each horizontal pixel array. The signal line driving circuit converts pixel data sequentially supplied from outside into a parallel form for each horizontal scanning period, converts these pixel data items for one horizontal pixel array into analog voltages, and supplies the analog voltages to the signal lines.

In the trend of resent years, the number of pixels in each horizontal pixel array is increased to improve the resolution of the active matrix LCD, and the word length of each pixel data is also increased to improve the precision of the gray scale. In order to increase the number of pixels and the word length, it is necessary for the signal line driving circuit to process the pixel data at a higher speed. However, if the processing speed of the signal line driving circuit is improved to its limit, it is difficult to drive all the signal lines within one horizontal scanning period.

To solve this problem, there has been a block drive technique by which each horizontal pixel array is divided into N pixel blocks (where N is an integer of two or more). According to this drive technique, the signal line driving circuit is constituted by N driver sections which respectively drive groups of signal lines for the pixel blocks, and first and second line memories are additionally provided each of which stores pixel data items for one horizontal pixel array to be distributed to the driver sections. In each horizontal scanning period, pixel data items for one horizontal pixel array are written into one of the first and second line memories, and pixel data items for another horizontal pixel array already written is read out from the other one of the memories. In this case, since the driver sections corresponding to the pixel blocks are operable in parallel to process the pixel data items distributed thereto, the processing speed of each driver section can be reduced to about 1/N of the speed required in the case where the number of the pixel data items corresponding to that of all the signal lines are sequentially processed.

However, this block drive technique has a drawback that the first and second line memories must be additionally provided. Since each of these first and second line memories must have a memory capacity capable of storing pixel data for one horizontal pixel array, the memory capacity significantly increases in accordance with increases in the number of pixels and the word length. Further, the first and second line memories must have characteristic which can transfer data at a higher speed required when the memory capacity is increased.

Therefore, when the block drive technique is adopted, it is impossible to avoid increases in costs for manufacturing a flat-panel display device.

SUMMARY OF THE INVENTION

An object of the present invention is to provide a flat-panel display device and a method of driving the same, which can maintain the memory capacity required for block-driving of each horizontal pixel array to be small.

The object of the present invention is achieved by a flat-panel display device comprising: a display panel having a plurality of pixels arrayed in a matrix, the pixels in each row forming one horizontal pixel array; a plurality of block driving circuits arranged in series to divide pixels in each horizontal pixel array to a plurality of pixel blocks, for driving the pixel blocks, respectively; M data supply buses each connected to at least one of the block driving circuits; and a control unit for distributing pixel data sequentially supplied from outside to the data supply buses; wherein the control unit includes a distributing circuit having a plurality of memory sections each of which stores items of pixel data for one pixel block and is capable of reading from one area while writing to another area, a total memory capacity of the memory sections being smaller than a memory capacity required for storing all items of pixel data for one horizontal pixel array, and the control circuit for performing a control of dividing pixel data items sequentially supplied from outside into pixel-data blocks each consisting of the same number of pixel data items, equivalent to the number of pixels forming one pixel block, sequentially writing M pixel-data blocks in M memory sections, reading the M pixel-data blocks stored in the M memory sections in parallel while writing is performed, and supplying the M pixel-data blocks to corresponding ones of the data supply buses.

The above object is further achieved by a method of driving a flat-panel display device which comprises a display panel having a plurality of pixels arrayed in a matrix, the pixels in each row forming one horizontal pixel array; a plurality of block driving circuits arranged in series to divide pixels in each horizontal pixel array to a plurality of pixel blocks, for driving the pixel blocks, respectively; M data supply buses each connected to at least one of the block driving circuits; and a control unit for distributing pixel data sequentially supplied from outside to the data supply buses; the control unit including a distributing circuit having a plurality of memory sections each of which stores items of pixel data for one pixel block and is capable of reading from one area while writing to another area, and a total memory capacity of the memory sections being smaller than a memory capacity required for storing all items of pixel data for one horizontal pixel array; comprising a first step of dividing pixel data items sequentially supplied from outside into pixel-data blocks each consisting of the same number of pixel data items, equivalent to the number of pixels forming one pixel block, a second step of sequentially writing M pixel-data blocks in M memory sections and reading the M pixel-data blocks stored in the M memory sections in parallel while writing is performed, and a third step of supplying the M pixel-data blocks to corresponding ones of the data supply buses.

According to the aforementioned flat-panel display device and its driving method, pixel data items sequentially supplied from outside are divided into pixel-data blocks each consisting of the same number of pixel data items, equivalent to the number of pixels forming one pixel block. M pixel-data blocks are sequentially written in M memory sections, and the M pixel-data blocks stored in the M memory sections are read in parallel while writing is performed. These M pixel-data blocks are supplied to corresponding ones of the data supply buses. Therefore, the total memory capacity of the memory sections is smaller than a memory capacity required for storing all items of pixel data for one horizontal pixel array. Further, the memory capacity of the memory section is not significantly depend on the number of pixel data items for one horizontal array and the word length of pixel data. This enables an increase in the number of pixel data items for one horizontal pixel array and an increase in the word length while maintaining the memory capacity of the memory section to be small. As a result of this, it is possible to prevent costs for manufacturing a flat-panel display device from being increased due to block driving of the horizontal pixel array.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A flat-panel display device according to a first embodiment of the present invention will now be described below, with reference to the accompanying drawings. This flat-panel display device is manufactured as an active matrix LCD of a light-transmission type which operates in a normally white mode.

Figure 1:
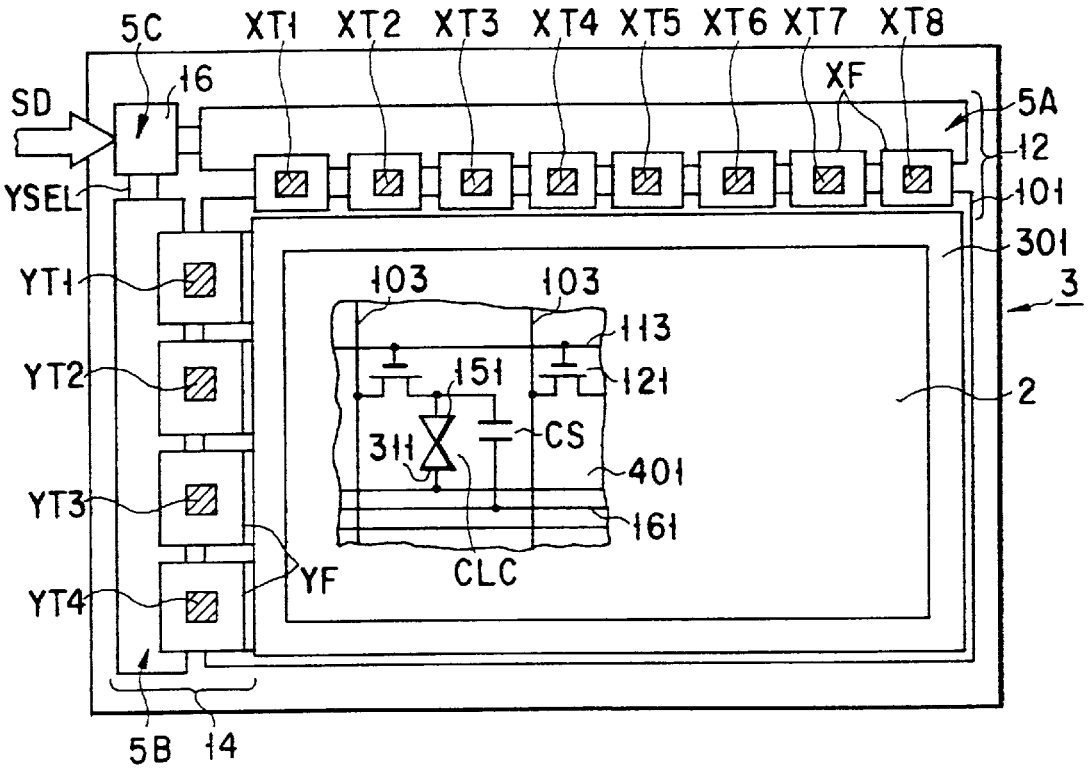
FIG. 1 is a plan view schematically showing a flat-panel display device according to a first embodiment of the present invention.
Figure 2:
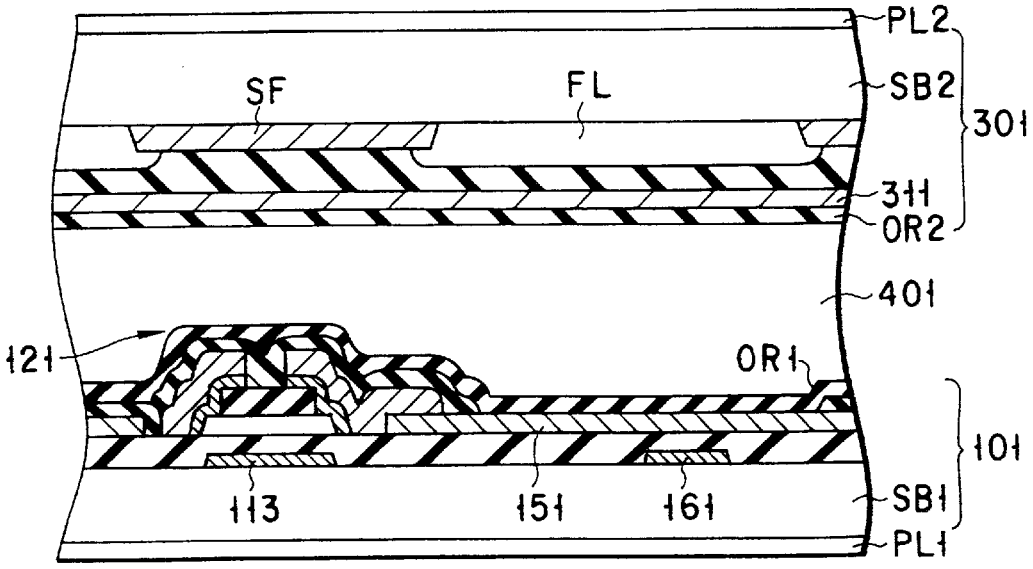
FIG. 2 is a cross-sectional view of a liquid crystal panel shown in FIG. 1.

FIG. 1 schematically shows a structure of the flat-panel display device, and FIG. 2 shows a cross sectional structure of the liquid crystal panel shown in FIG. 1. The flat-panel display device comprises a liquid crystal panel 3 capable of color display. In the liquid crystal panel 3, a display area 2 is provided with a size of 14 inches in its diagonal direction. This liquid crystal panel 3 includes an array substrate 101, a counter substrate 301, a liquid crystal layer 401 made of a liquid crystal composite and held between the array substrate 101 and the counter substrate 301 as a light modulation layer, and polarizing plates PL1 and PL2 attached to the outer surfaces of the array substrate 101 and the counter substrate 301, such that polarizing axes of the plates are perpendicular to each other. The liquid crystal panel 3 is fabricated by applying a sealing agent to the outer peripheral portions of the array substrate 101 and the counter substrate 301 to bond these array substrate 101 and the counter substrate 301, and filling a liquid crystal composite within a gap surrounded by the sealing agent between the array substrate 101 and the counter substrate 301.

The array substrate 101 comprises a glass substrate SB1, 600×2400 pixel electrodes 151 arrayed in a matrix on the glass substrate SB1, 600 scanning lines 113 (Y1 to Y600) formed along rows of the pixel electrodes 151, 1920 signal lines 103 (X1 to X2400) formed along columns of the pixel electrodes 151, 600×2400 Thin Film Transistors (TFTS) 121 formed as switching elements near intersections between the scanning lines 113 and the signal lines 103, 600 storage capacity lines 161 each having areas overlapping the pixel electrodes 151 of a corresponding row and formed in substantially parallel with the scanning lines 113, and a first orientation film OR 1 which entirely covers a matrix array of the pixel electrodes 151. The TFT 121 has an inverted staggered TFT structure in which an amorphous silicon thin film is used as an active layer. The pixel electrode 151 is a transparent conductive film made of Indium Tin Oxide (ITO). The storage capacitance lines 161 and the pixel electrodes 151 constitute a storage capacitance CS.

The counter substrate 301 comprises a glass substrate SB2, a matrix light shutting film formed on the glass substrate SB2 such that the film masks peripheral portions of the pixel electrodes 151, a color filter FL formed on the glass substrate SB2 exposed through the matrix light shutting layer ST, a counter electrode 311 opposing the matrix array of the pixel electrodes 151, and a second orientation film OR2 which entirely covers the counter electrode 311. The light shutting film ST shuts off light entering into the TFTs 121, light passing through spaces between the signal lines 103 and the pixel electrodes 151, and light passing through spaces between the scanning lines 113 and the pixel electrodes 151. The color filter FL consists of red, green, and blue color stripes which respectively transmit corresponding color components, and these color stripes are repeatedly disposed in the row direction of the pixel electrodes 151. The counter electrode 311 is a transparent conductive film made of Indium Tin Oxide (ITO), likewise the pixel electrodes 151. The first orientation film OR1 and the second orientation film OR2 are provided for causing liquid crystal molecules to be set in a Twisted Nematic (TN) alignment when there is no potential difference between the pixel electrode 151 and the counter electrode 311. Each of TFTs 121 has a gate connected to one of the scanning lines 113, and a source-drain path connected between one of the signal lines 103 and one of the pixel electrodes 151. The pixel electrode 151 and the counter electrode 311 constitute a liquid crystal capacitance CLC. The storage capacitance line 161 is connected to the counter electrode 311.

In the liquid crystal panel 3 as described above, the display area 2 has 600 horizontal pixel arrays each consisting of 800 groups of RGB pixels. The RGB pixels of each group correspond to adjacent three pixel electrodes 151. In order to reduce the outer size of the display device, the signal lines 103 and the scanning lines 113 are extended from only one end side of the liquid crystal panel 3 in the column and row directions of the pixel electrodes 151.

(Note that the orientation films OR1 and OR2 as well as polarizing plates PL1 and PL2 are not necessary when polymer-dispersed liquid crystal having transparent resin mixed with liquid crystal material is used as the liquid crystal composite.)

This display device further comprises a signal line driving circuit 12 for driving signal lines X1 to X2400, a scanning line driving circuit 14 for driving scanning lines Y1 to Y600, and a liquid crystal controller 16 for controlling the signal line driving circuit 12 and the scanning line driving circuit 14. The signal line driving circuit 12 includes a signal line driving circuit substrate 5A and Tape Carrier Packages (TCPs) forming driver sections XT1, XT2, . . . , XT8 on wiring films XF. The scanning line driving circuit 14 includes a scanning line driving circuit substrate 5B and TCPs forming driver sections YT1, YT2, . . . ,YT4 on wiring films YF. The liquid crystal controller 16 is constituted by a programmable logic array and is arranged on a control circuit substrate 5C. The liquid crystal controller 16 receives RGB pixel data sequentially supplied from outside at a rate of 800 items (=the number of groups of RGB pixels) per horizontal scanning period, and supply these RGB pixel data items together with various control signals to the signal line driving circuit 12. Each RGB pixel data item is made of a combination of R pixel data, G pixel data, and B pixel data respectively representing red, green, and blue color components. Each of R, G, and B pixel data has a word length of six bits so as to display a corresponding color component in 64 (=$2^6$) gray levels. Therefore, each RGB pixel data item has a word length of 18 bits as a total of the word lengths of R, G, and B pixel data items. The above-mentioned various control signals include a start pulse ST generated prior to supply of RGB pixel data for one horizontal pixel array, a load pulse LD generated upon completion of supply of the RGB pixel data for one horizontal pixel array, and a clock pulse CK generated each time two RGB pixel data items are supplied. The clock pulse CK is generated at a frequency of 18 MHz which is half the system clock frequency (=36 MHz). Further, the liquid crystal controller 16 supplies control signals YSEL including a start pulse and a clock pulse to the scanning line driving circuit 14 so as to select one of scanning lines Y1 to Y600 for each horizontal scanning period equal to a period of 1024 clocks (=28 $\mu$s). The signal line driving circuit 12 receives RGB pixel data for one horizontal pixel array from the liquid crystal controller 16 for each horizontal scanning period, converts R, G, and B pixel data items contained in every RGB pixel data item into analog pixel signal voltages, and supplies them in parallel to the signal lines X1 to X2400. The scanning line driving circuit 14 sequentially selects the scanning lines Y1 to Y600 on the basis of the control signals YSEL from the liquid crystal controller 16, and supplies a scanning pulse to a selected scanning line. TFTs 121 for each horizontal pixel array are rendered conductive upon rise of a scanning pulse supplied through corresponding one of the scanning lines Y1 to Y600, and respectively supply pixel signal voltages which are supplied in parallel through the signal lines X1 to X2400, to the pixel electrodes 151 of the horizontal pixel array. The liquid crystal capacitances CLC and storage capacitances CS are charged by the pixel signal voltages thus supplied. These TFTs 121 are rendered non-conductive upon fall of the scanning pulse, and then potential differences between the pixel electrodes 151 and the counter electrode 311 are maintained by the liquid crystal capacitances CLC and the storage capacitances CS. The potential differences are updated when the TFTs 121 are rendered conductive again after one frame period.

The TCPs of the signal line driving circuit 12 form the driver sections XT1, XT2, . . . , and XT8 which are arranged in series on the wiring films XF and respectively drive signal lines X1 to X2400 in units of 300 lines such that the matrix array of pixel electrodes 151 are divided into eight blocks in the row direction. The signal lines X1 to X2400 are connected through an anisotropic conductive film to output ends of the driver sections XT1 to XT8. Input ends of these driver sections XT1 to XT8 are connected by soldering to a wiring pattern formed on the signal line driving circuit substrate 5A, and the wiring pattern is connected to the liquid crystal controller formed on the control circuit substrate 5C.

In addition, the TCPs of the scanning line driving circuit 14 form the driver sections YT1, YT2, YT3, and YT4 which are arranged in series on the wiring films YF and respectively drive the scanning lines Y1 to Y600 in units of 150 such that the matrix array of pixel electrodes 151 is divided into four blocks in the column direction. The scanning lines Y1 to Y600 are connected to output ends of the driver sections YT1 to YT4 through an anisotropic conductive film. The input ends of these driver sections YT1 to YT1 are connected by soldering to a wiring pattern formed on the scanning line driving circuit substrate 5B, and the wiring pattern is further connected by soldering to the liquid controller 16 formed on the control circuit substrate 5C. The driver sections YT1 to YT4 have a structure basically similar to a conventional display device.

Figure 3:
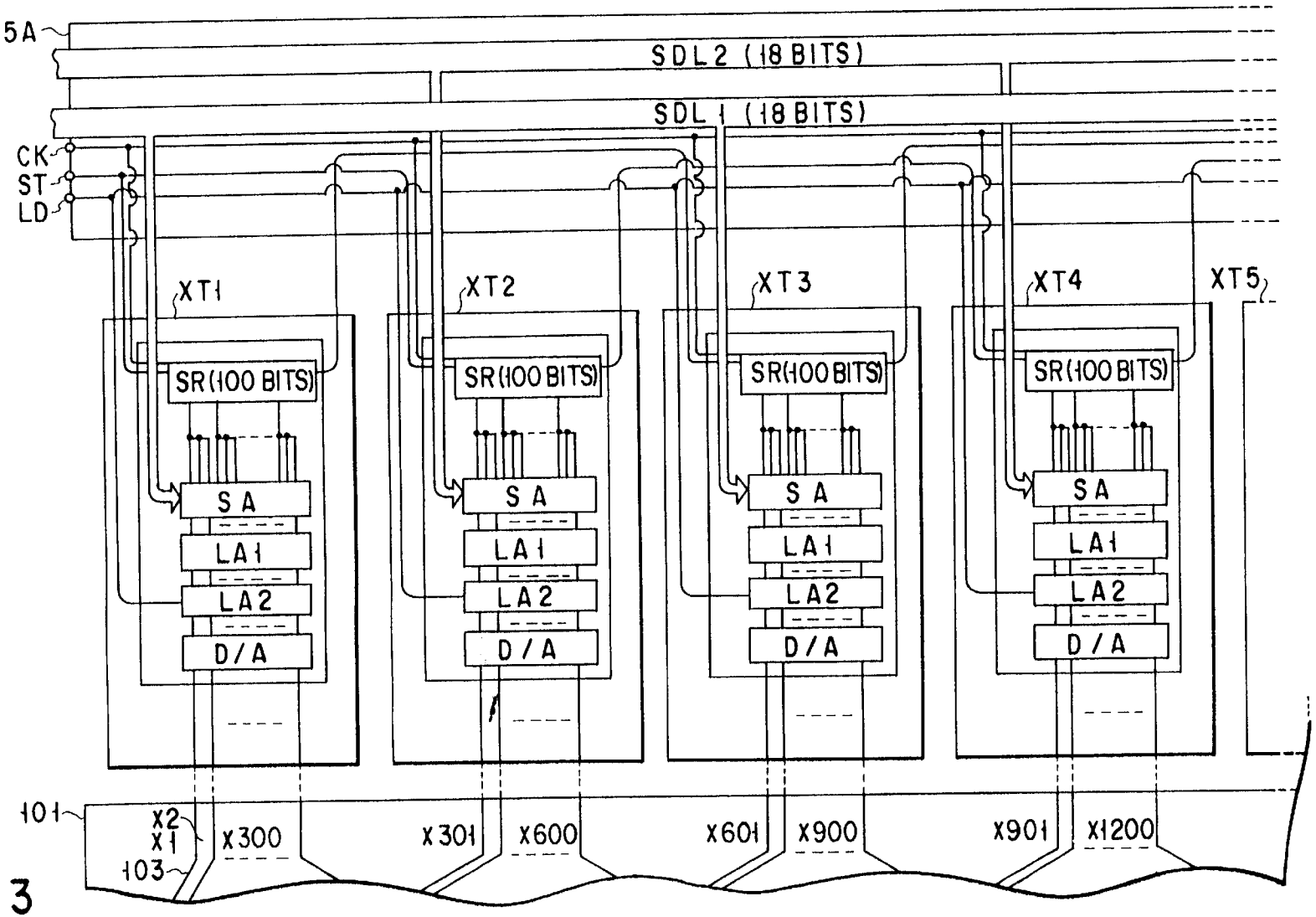
FIG. 3 is a block diagram showing a part of a signal line driving circuit formed on a signal line drive substrate and wiring films shown in FIG. 1.

The signal line driving circuit 12 is arranged such that a group of odd-numbered driver sections XT1, XT3, XT5, and XT7 and a group of even-numbered driver sections XT2, XT4, XT6, and XT8 are driven in parallel by means of a block driving technique using data supply buses SDL2 and SDL1, as shown in FIG. 3. Each of the driver sections XT1 to XT8 is constituted by a shift register circuit SR of 100 stages (or bits), a selection circuit SA, a latch circuit LA1, a latch circuit LA2, and a digital-analog converter D/A.

In the group of odd-numbered driver sections XT1, XT3, XT5, and XT7, all the shift register circuits SR are connected in series with each other. Specifically, the first stage of the shift register circuit SR of the driver section XT1 is connected to receive a start pulse ST supplied from the liquid crystal controller 16, while the last stage of the shift register circuit SR of this driver section XT1 is connected to the first stage of the driver section XT3. The last stage of the shift register circuit SR of the driver section XT3 is connected to the first stage of the shift register circuit SR of the driver section XT5, and the last stage of the shift register circuit SR of the driver section XT5 is connected to the first stage of the shift register circuit SR of the driver section XT7. Each of the shift register circuits SR of the driver sections XT1, XT3, XT5, and XT7 are connected to receive a clock pulse CK supplied from the liquid crystal controller 16. The selection circuits SA of the driver sections XT1, XT3, XT5, and XT7 are connected commonly to the data supply bus SDL1, and are respectively connected to the shift register circuits SR of the driver sections XT1, XT3, XT5, and XT7. The latch circuits LA2 of the driver sections XT1, XT3, XT5, and XT7 are connected to receive a load pulse LD supplied from the liquid crystal controller 16, and are connected to the latch circuits LA1 of the driver sections XT1, XT3, XT5, and XT7. The digital-analog converters D/A of the driver sections XT1, XT3, XT5, and XT7 are connected to the latch circuits LA2 of the driver sections XT1, XT3, XT5, and XT7, and are respectively connected to the grouped signal lines X1 to X300, the grouped signal lines X601 to X900, the grouped signal lines X1201 to X1500, and the grouped signal lines X1801 to X2100. Each shift register circuit SR sequentially shifts a start pulse ST to the next stage, in response to a clock pulse CK. Each selection circuit SA extracts RGB pixel data SD of 18 bits from the data supply bus SDL2 in response to a start pulse from each stage of a corresponding shift register circuit SR, and supplies R, G, and B pixel data items of six bits contained in the extracted RGB pixel data SD in parallel to a corresponding latch circuit LA1. Each latch circuit LA2 latches pixel data items for 300 pixels from the latch circuit LA1 in response to a load pulse LD, and supplies the pixel data items for 300 pixels to a corresponding digitalanalog converter D/A. Each digital-analog converter D/A converts pixel data items for 300 pixels into pixel signal voltages and supplies the pixel signal voltages to 300 corresponding signal lines.

In the group of even-numbered driver sections XT2, XT4, XT6, and XT8, all the shift register circuits SR are connected in series with each other. Specifically, the first stage of the shift register circuit SR of the driver section XT2 is connected to receive a start pulse ST supplied from the liquid crystal controller 16, while the last stage of the shift register circuit SR of this driver section XT2 is connected to the first stage of the driver section XT4. The last stage of the shift register circuit SR of the driver section XT4 is connected to the first stage of the shift register circuit SR of the driver section XT6, and the last stage of the shift register circuit SR of the driver section XT6 is connected to the first stage of the shift register circuit SR of the driver section XT8. Each of the shift register circuits SR of the driver sections XT2, XT4, XT6, and XT8 are connected to receive a clock pulse ST supplied from the liquid crystal controller 16. The selection circuits SA of the driver sections XT2, XT4, XT6, and XT8 are connected commonly to the data supply bus SDL2, and are respectively connected to the shift register circuits SR of the driver sections XT2, XT4, XT6, and XT8. The latch circuits LA2 of the driver sections XT2, XT4, XT6, and XT8 are connected to receive a load pulse LD supplied from the liquid crystal controller 16, and are connected to the latch circuits LA1 of the driver sections XT2, XT4, XT6, and XT8. The digital-analog converters D/A of the driver sections XT2, XT4, XT6, and XT8 are connected to the latch circuits LA2 of the driver sections XT2, XT4, XT6, and XT8, and are respectively connected to the grouped signal lines X301 to X600, the grouped signal lines X901 to X1200, the grouped signal lines X1501 to X1800, and the grouped signal lines X2101 to X2400. Each shift register circuit SR sequentially shifts a start pulse ST to the next stage, in response to a clock pulse CK. Each selection circuit SA extracts RGB pixel data SD of 18 bits from the data supply bus SDL2 in response to a start pulse from each stage of a corresponding shift register circuit SR, and supplies R, G, and B pixel data items of six bits contained in the extracted RGB pixel data SD in parallel to a corresponding latch circuit LA1. Each latch circuit LA2 latches pixel data items for 300 pixels from the latch circuit LA1 in response to a load pulse LD, and supplies the pixel data items for 300 pixels to a corresponding digital-analog converter D/A. Each digital-analog converter D/A converts pixel data items for 300 pixels into pixel signal voltages and supplies the pixel signal voltages to 300 corresponding signal lines.

Figure 4:
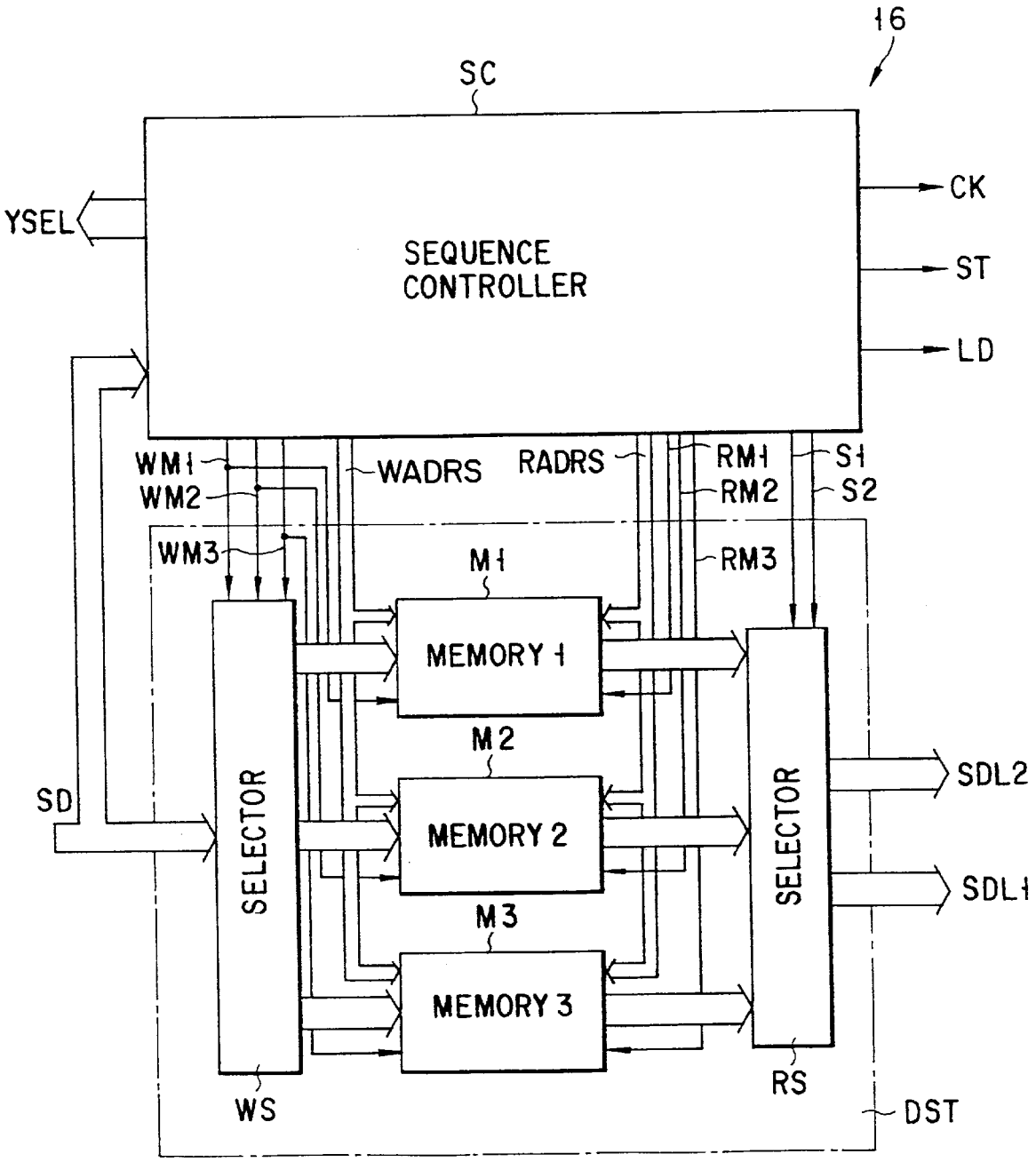
FIG. 4 is a block diagram showing a liquid crystal controller formed on a control circuit substrate shown in FIG. 1.

As is shown in FIG. 4, the liquid crystal controller 16 includes a data distribution circuit DST for distributing RGB pixel data sequentially supplied from outside to the data supply buses SDL1 and SDL2, and a sequence controller SC for controlling operation of the data distribution circuit DST and for generating control signals YSEL to be supplied to the scanning line driving circuit 14 and control signals such as a start pulse ST, a clock pulse CK, a load pulse LD, and the like to be supplied to the signal line driving circuit 12.

The data distribution circuit DST has a selector WS, memories M1 to M3, and a selector RS. The selector WS selects one of the memories M1, M2, and M3, and supplies the selected memory with RGB pixel data SD sequentially supplied from outside. Each of the memories M1 to M3 has one hundred memory areas of 18 bits, and is formed as a 2-port RAM capable of reading data from a memory area while writing data into another memory area. The memory capacity thereof is selected so as to store all the RGB pixel data to be processed by one of the driver sections XT1 to XT8. Each of the memories M1, M2, and M3 stores one hundred items of RGB pixel data SD sequentially supplied through the selector WS as one block. The selector RS distribute two blocks of RGB pixel data SD read in parallel from two of the memories M1, M2, and M3, to the data supply buses SDL1 and SDL2.

To control operations of the selector WS, memories M1 to M3, and selector RS as mentioned above, the sequence controller SC generates write control signals WM1, WM2, and wM3, a write address signal WADRS, read control signals RM1, RM2, and RM3, a read address signal RADRS, and control signals S1 and S2. The write control signals WM1, WM2, and WM3 are supplied commonly to the selector WS, and are simultaneously supplied to the memories M1, M2, and M3, respectively. The write address signal WADRS and read address signal RADRS are commonly supplied to the memories M1, M2, and M3. The read control signals RM1, RM2, and RM3 are respectively supplied to the memories M1, M2, and M3. The control signals S1 and S2 are commonly supplied to the selector RS.

The sequence controller SC generates write control signals in the order of WM1, WM2, WM3, WM1, WM2, WM3, operation, one after another. In this manner, the selector WS selects memories M1, M2, and M3 in this order, and supplies RGB pixel data SD sequentially supplied from outside to the selected one of the memories M1, M2, and M3. The write control signals WM1, WM2, and WM3 are sequentially changed each time one hundred items of RGB pixel data SD are supplied. The selected memory stores the RGB pixel data SD supplied from the selector WS into a write memory area designated by a write address signal WADRS. The write address signal WADRS is updated in a cycle corresponding to a supply rate of RGB pixel data SD, and one hundred items of RGB pixel data SD are written into the first to hundredth memory areas. While thus performing write operation, the sequence controller SC generates read control signals in the order of RM1 and RM2, RM3 and RM1, RM2 and RM3, RM1 and RM2, RM3 and RM1, RM2 and RM3, . . . , to make paired two of the memories M1, M2, and M3 perform read operation, one pair after another pair. Each of these paired two memories reads RGB pixel data SD from a read memory area designated by a read address signal RADRS, and supplies the data to the selector RS. The read address signal RADRS is updated in a cycle substantially corresponding to the half of the supply rate of RGB pixel data SD, and one hundred items of RGB pixel data SD are sequentially read out from the first to hundredth memory areas. The selector RS distributes two blocks of RGB pixel data SD, which are read out in parallel from two of the memories M1 to M3 under control by control signals S1 and S2, to data supply buses SDL1 and SDL2 corresponding to the odd-numbered and even-numbered driver sections. As a result of this, RGB pixel data SD for each horizontal pixel array is divided into eight blocks, and four odd-numbered blocks thereof are respectively supplied to the driver sections XT1, XT3, XT5, and XT7 through the data supply bus SDL1, while four even-numbered blocks are respectively supplied to the driver sections XT2, XT4, XT6, and XT8 through the data supply bus SDL2.

Figure 5:
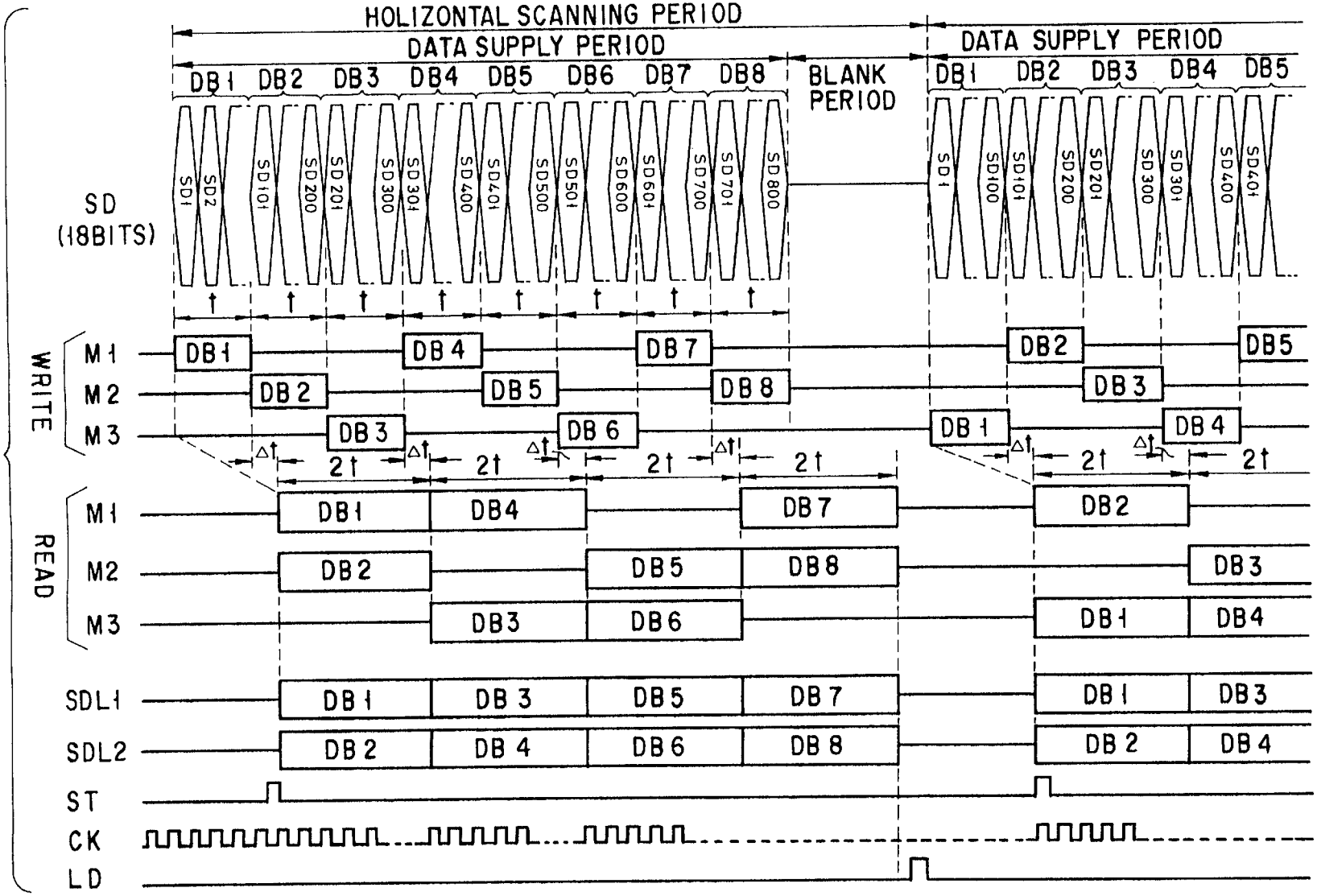
FIG. 5 is a time-chart for explaining an operation of the flat-panel display device shown in FIG. 1.

FIG. 5 shows an operation of a flat-panel display device having the structure as described above.

Each horizontal scanning period consists of a data supply period (=28×800/1024 $\mu$ s) and a blank period (=28×224/1024 $\mu$ s), and 800 items of 18-bit RGB pixel data SD equivalent to the number of pixels forming one horizontal pixel array are sequentially supplied from outside to the liquid crystal controller 16 within the data supply period. These 800 items of RGB pixel data SD are divided in units of 100 items by a selector WS into eight RGB pixel-data blocks DB1 to DB8 which are respectively assigned to driver sections XT1, XT2, . . . , and XT8. Memories M1, M2, and M3 sequentially store the RGB pixel-data blocks DB1 to DB8. Each of the RGB pixel-data blocks DB1 to DB8 is written into one of the memories M1, M2, and M3 within one block period (=t) equivalent to ⅛ of the data supply period, that is 28×100/1024 $\mu$ s. Specifically, RGB pixel-data blocks DB1 to DB3 are respectively written into memories M1, M2, and M3, for example. These memories M1, M2, and M3 are repeatedly used to respectively store following RGB pixel-data blocks DB4 to DB8.

Reading from the memories M1 to M3 is performed while writing into the memories M1 to M3 is performed as described above. In this reading, consecutive two of RGB pixel-data blocks DB1 to DB8 are read out in parallel within two block periods (=2t). Specifically, RGB pixel-data blocks DB1 and DB2 are read out in parallel from the memories M1 and M2 within first two block periods, and RGB pixel-data blocks DB3 and DB4 are read out in parallel from the memories M3 and M1 from next two block periods (=2t). RGB pixel-data blocks DB5 and DB6 are read out in parallel from the memories M2 and M3 within further next two block periods (=2t), and RGB pixel-data blocks DB7 and DB8 are read out in parallel from the memories M1 and M2 within further next two block periods (=2t).

The RGB pixel-data blocks DB1 and DB2, DB3 and DB4, DB5 and DB6, as well as DB7 and DB8 which are thus read out in parallel are distributed to the data supply buses SDL1 and SDL2 through the read selector RS. Specifically, odd-numbered pixel-data blocks DB1, DB3, DB5, and DB7 are supplied to the data supply bus SDL1 connected to odd-numbered driver sections XT1, XT3, XT5, and XT7, while even-numbered RGB pixel-data blocks DB2, DB4, DB6, and DB8 are supplied to the data supply bus SDL2 connected to even-numbered driver sections XT2, XT4, XT6, and XT8.

Meanwhile, each of the memories M1 to M3 has a memory capacity of only 100 words×18 bits, and therefore cannot contain RGB pixel data more than one block. Therefore, the sequence controller performs control such that before completion of writing of consecutive two RGB pixel-data blocks, parallel reading of these two RGB pixel-data blocks is started, and before completion of the parallel writing of the two RGB pixel-data blocks, consecutive writing of subsequent two RGB pixel-data blocks is started. The sequence controller SC also controls the data distribution circuit DST such that writing of each RGB pixel data is not overtaken by reading thereof.

For example, with respect to a memory M1, a RGB pixel-data block DB1 is written therein for one block period (=t), and thereafter, this block is read out therefrom for two block periods (=2t) delayed by a period of Δ t. Specifically, writing of a RGB pixel-data block DB4 is started earlier by the period of Δ t than completion of reading of the RGB pixel-data block DB1. However, in the memory M1, since reading of the RGB pixel-data block DB1 has already started when the writing of the RGB pixel-data block DB4 is started, the RGB pixel data of the block DB4 is sequentially written into the memory area from which RGB pixel data of the block DB1 has already been read out. Therefore, the memory M1 can even store the RGB pixel-data block DB4 within the given memory capacity. Note that the RGB pixel-data block DB4 is also read out with a delay of period Δ t from writing. Since the Δ t is set to a desired period of 160 ns which can be selected from 1 clock period (=27.7 ns) to 99 clock periods, writing of each RGB pixel data item is not overtaken by the reading thereof.

Therefore, even if each of memories M1 to M3 has a capacity of 100 words×18 bits, it is possible to write each RGB pixel-data block obtained by dividing RGB pixel data items for one horizontal pixel array in units of 100 items to be processed by the driver section XT1, XT2, . . . , or XT8, into one of memories M1 to M3 at a data supply rate, to read consecutive two RGB pixel-data blocks from two of the memories M1 to M3 in parallel at a half rate of the data supply rate, and to distribute the read data blocks to the data supply buses SDL1 and SDL2. Specifically, odd-numbered RGB pixel-data blocks DB1, DB3, DB5, and DB7 as well as even-numbered RGB pixel-data blocks DB2, DB4, DB6, and DB8 are respectively supplied to the data line supply line SDL1 connected to the odd-numbered driver sections XT1, XT3, XT5, and XT7 as well as the data supply bus SDL2 connected to the even-numbered driver sections XT2, XT4, XT6, and XT8. As a result of this, RGB pixel-data blocks DB1 and DB2 are processed in parallel by driver sections XT1 and XT2, RGB pixel-data blocks DB3 and DB4 are processed in parallel by driver sections XT3 and XT4, RGB pixel-data blocks DB5 and DB6 are processed in parallel by driver sections XT5 and XT6, and RGB pixel-data blocks DB7 and DB8 are processed in parallel by driver sections XT7 and XT8.

For example, driver sections XT1 and XT2 perform the following processing while RGB pixel-data blocks DB1 and DB2 are supplied in parallel to the data supply buses SDL1 and SDL2.

In the driver section XT1, first to hundredth stages of the shift register store a start pulse ST in turns in response to clock pulses CK. The selection circuit SA selects corresponding one of hundred RGB pixel data items sequentially supplied to data supply bus SDL1 as a RGB pixel-data block DB1, in response to a signal from a stage which stores the start pulse ST, and supplies three pixel data items of the selected RGB pixel data (i.e., R pixel data, G pixel data, and B pixel data each consisting of six bits) to the latch circuit LA1, simultaneously. The latch circuit LA1 latches each of pixel data items sequentially supplied from the selection circuit SA in correspondence with hundred RGB pixel data items, and supplies the pixel data items into the latch circuit LA2. The latch circuit LA2 latches all the pixel data items from the latch circuit LA1 in response to a load pulse LD, and supplies the pixel data items to the digital-analog converter D/A. The digital-analog converter D/A converts the pixel data items into pixel signal voltages, respectively, and supplies to signal lines X1 to X300.

In the driver section XT2, first to hundredth stages of the shift register store a start pulse ST in turns in response to clock pulses CK. The selection circuit SA selects corresponding one of hundred RGB pixel data items sequentially supplied to data supply bus SDL2 as a RGB pixel-data block DB2, in response to a signal from a stage which stores the start pulse ST, and supplies three pixel data items of the selected RGB pixel data (i.e., R pixel data, G pixel data, and B pixel data each consisting of six bits) to the latch circuit LA1, simultaneously. The latch circuit LA1 latches each of pixel data items sequentially supplied from the selection circuit SA in correspondence with hundred RGB pixel data items, and supplies the pixel data items into the latch circuit LA2. The latch circuit LA2 latches all the pixel data items from the latch circuit LA1 in response to a load pulse LD, and supplies the pixel data items to the digital-analog converter D/A. The digital-analog converter D/A converts the pixel data items into pixel signal voltages, respectively, and supplies to signal X301 to X600.

The other driver sections XT3 and XT4, XT5 and XT6, as well as XT7 and XT8 also operate in parallel in the same manner as described above. Since odd-numbered driver sections XT1, XT3, XT5, and XT7 and even-numbered driver sections XT2, XT4, XT6, and XT8 are thus operated in parallel, clock pulses CK are generated at a half frequency of the frequency adopted when these driver sections are not operated in parallel. Therefore, the operation speed of the driver sections XT1 to XT8 is reduced in accordance with the frequency of the clock pulses CK.

As has been explained above, according to the flat-panel liquid crystal display device, block driving can be achieved with a very small total memory capacity of 5.4k bits (=3×100×18 bits) of memories M1 to M3 while the operation speed of driver sections XT1 to XT8 is reduced to half, although RGB pixel data for one horizontal pixel array consists of an information amount of 14k bits (=2400×6 bits). Therefore, it is possible to fabricate a liquid crystal controller 16 using a small size programmable logic array of a low price, so that the manufacturing cost of the display device can be reduced. Further, since the frequency of clock pulses CK is reduced to ½, a shift register circuit SR of a low speed type can be used in each of driver sections XT1 to XT8. This is effective for reduction of electric power consumption of the display device.

In the above embodiment, RGB pixel data SD for one horizontal pixel array is divided into eight blocks in correspondence with the number of driver sections. However, in a case where ten driver sections are provided, for example, RGB pixel data SD for one horizontal pixel array is divided into ten blocks. As a result of this, the number of 18-bit memory areas provided in each of the memories M1 to M3 can be reduced to 80. In addition, it is preferable that the number of driver sections is set to a multiple p of the number of data supply buses (where p is a positive integer of 2 or more).

Also in the above embodiment, three memories M1 to M3 are provided to drive odd- and even-numbered driver sections in parallel. However, driver sections may be divided into three or more groups or blocks, which may be driven in parallel with each other. In this case, although memories M1 to M3 must be increased in accordance with the number of groups, the frequency of clock pulses CK can be reduced to 1/number of groups. Therefore, the operation speed of the shift register circuit SR can be much more reduced. For example, supposing a case where one horizontal pixel array includes 3072 pixel electrodes, 16 driver sections each of which drives 192 signal lines may be provided and divided into four groups with use of four data supply buses. In this case, seven memories each having sixty four 18-bit memory areas may be used, so that RGB pixel data for one horizontal pixel array may be divided into corresponding 16 blocks, and these blocks may be supplied to the four data supply buses, in units of four blocks. Although this case requires increases in number of driver sections and memories, it is possible to reduce the frequency of clock pulses CK to ¼ of the frequency used when 16 driver sections are not divided into four groups, and therefore, the operation speed and power consumption of the shift register circuit SR can be reduced accordingly.

In this embodiment, the driver sections XT1 to XT8 are fixed as an integrated circuit on flexible wiring films XF. However, this integrated circuit may be fixed on the array substrate 101 of the liquid crystal panel 3 with use of an anisotropic conductive film or the like, and may be connected to data supply buses SDL1 and SDL2 on the array substrate 101. In this case, the signal line driving circuit substrate 5A is not required, and therefore, the dimensions of the outer portion of the display area 2 can be reduced. In addition, if the signal line driving circuit 12 is formed on the array substrate 101 in a step of manufacturing the liquid crystal panel 3, such that the signal line driving circuit 12 is connected to signal lines 103 with use of poly-silicon or the like, it is possible to eliminate troublesome services for connecting the signal lines 103 with the signal line driving circuit 12 after production of the liquid crystal panel 3.

Figure 6:
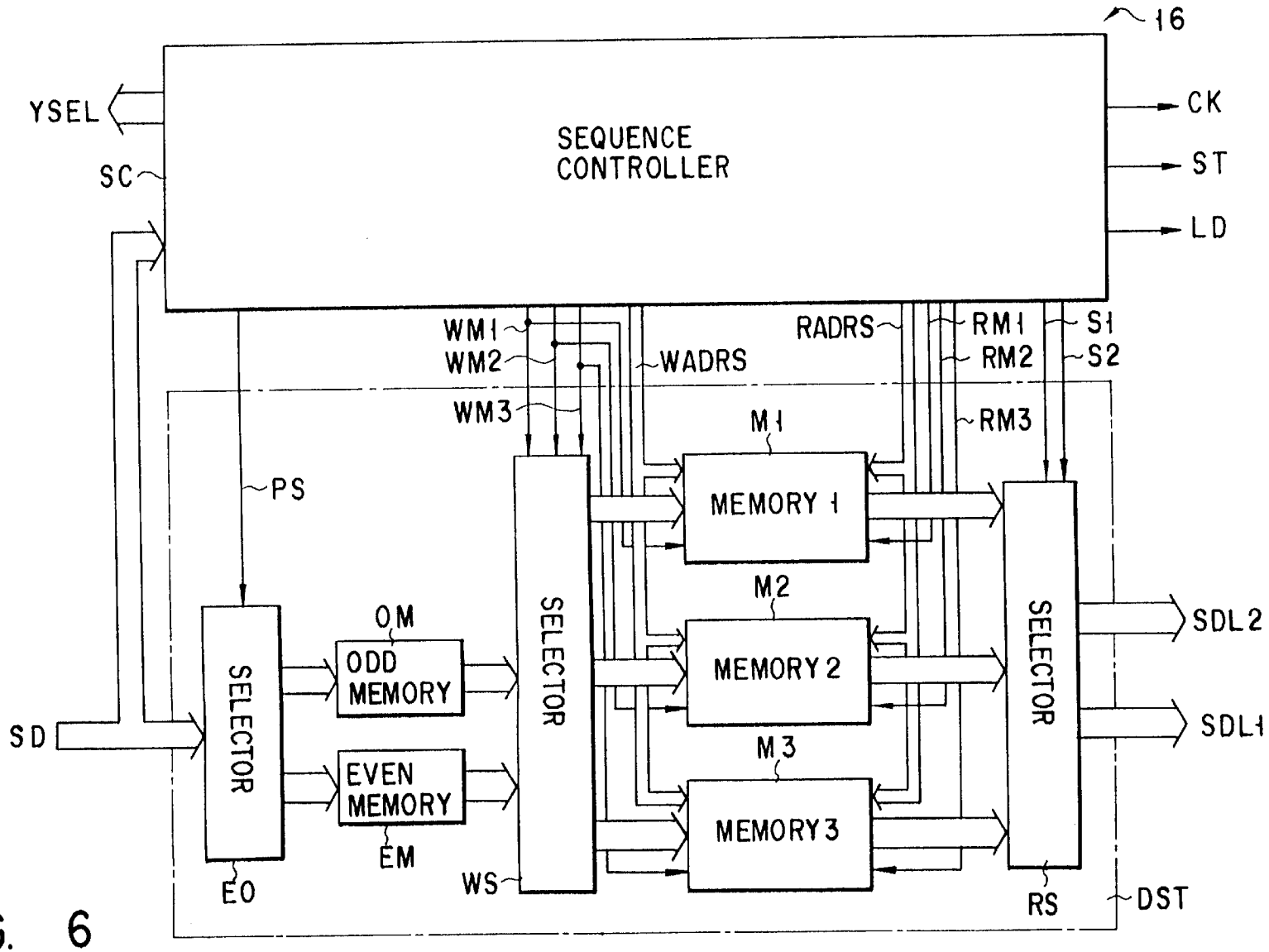
FIG. 6 is a block diagram showing a modification of the liquid crystal controller shown in FIG. 4.

FIG. 6 shows a modification of the liquid crystal controller shown in FIG. 4. In this modification, the data distribution circuit DST is additionally provided with a selector EO, an odd-memory OM, and an even-memory EM. The selector EO is controlled by a control signal PS supplied from the sequence controller SC, and supplies RGB pixel data sequentially supplied from outside to the odd-memory OM and the even-memory EM, alternately. Each of the odd- and even-memories OM and EM is a 18-bit memory for storing one RGB pixel data item, and stores RGB pixel data supplied from the selector EO and then supplies the RGB pixel data to the selector WS. The selector WS supplies one of memories M1 to M3 with RGB pixel data of two words respectively supplied from the odd- and even-memories OM and EM. Each of the memories M1 to M3 has fifty 36-bit memory areas having the same memory capacity as that shown in FIG. 4, and stores fifty sets of 2-word RGB pixel data as one block. The selector RS distributes two blocks of 2-word RGB pixel data which are read out in parallel from two of the memories M1, M2, and M3, to the data supply buses SDL1 and SDL2.

In this case, the number of bits for the data supply buses SDL1 and SDL2 is set to 32, and the number of stages of the shift register circuit SR is set to 50 in each of driver sections XT1 to XT8. The frequency of clock pulses CK is set to the half of the frequency adopted in the above-mentioned embodiment. Therefore, the selection circuit SA selects corresponding one of fifty 2-word RGB pixel data items sequentially supplied as one RGB pixel-data block DB1 to the data supply bus SDL2, in response to a signal from the stage storing a start pulse ST, and supplies six pixel data items of the selected 2-word RGB pixel data (i.e., first R pixel data, first G pixel data, first B pixel data, second R pixel data, second G pixel data, and second B pixel data each consisting of six bits) to the latch circuit LA1, simultaneously.

According to this modification, the total memory capacity in the data distribution circuit DST is increased by 32 bits. However, since the number of bits for the data supply buses SDL1 and SDL2 becomes twice, the number of stages of the shift register circuit SR is reduced by half in each of driver sections XT1 to XT8. It is therefore possible to further reduce the operation speed and power consumption of the shift register circuit SR.

Figure 7:
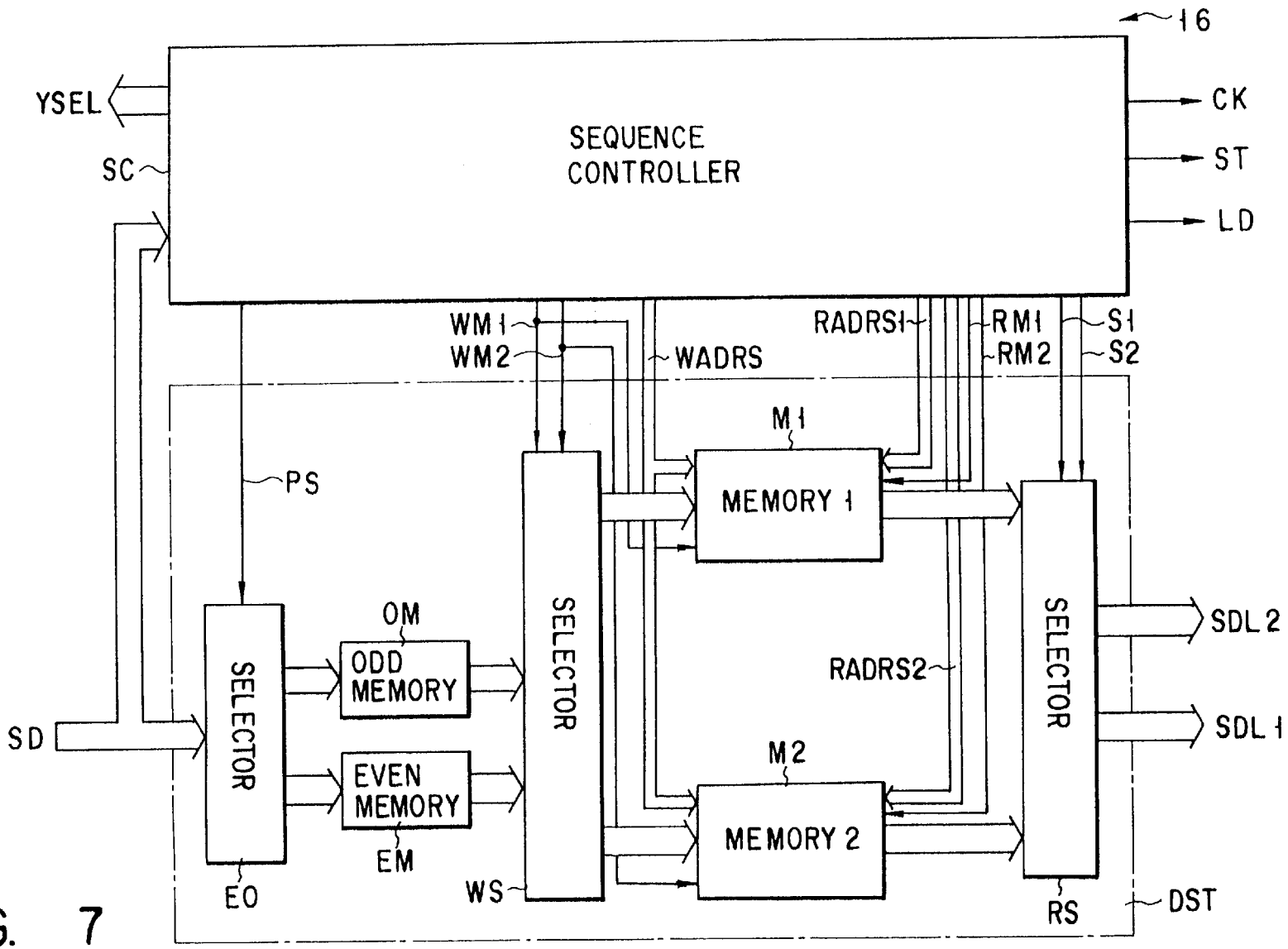
FIG. 7 is a block diagram showing a liquid crystal controller of a flat-panel display device according to a second embodiment of the present invention.

A flat-panel display device according to a second embodiment of the present invention will now be described below. This display device is constructed in the same manner as in the first embodiment, except for the signal line driving circuit 12 and the liquid crystal controller 16 shown in FIG. 4. The second embodiment adopts a signal line driving circuit 12 having the same structure as explained in the abovementioned modification. FIG. 7 shows a liquid crystal controller 16 of the flat-panel display device according to the second embodiment.

This liquid crystal controller 16 includes a data distribution circuit DST for distributing RGB pixel data SD which is sequentially supplied from outside to data supply buses SDL1 and SDL2, and a sequence controller SC for controlling operation of the data distribution circuit DST and for generating control signals YSEL to be supplied to the scanning line driving circuit 14 and signals such as a start pulse ST, a clock pulse CK, a load pulse LD, and the like to be supplied to the signal line driving circuit 12.

The data distribution circuit DST includes a selector EO, an odd-memory OM, an even-memory EM, a selector WS, memories M1 and M2, as well as a selector RS. The selector EO alternately supplies the odd- and even-memories OM and EM with RGB pixel data sequentially supplied from outside. Each of the odd-memory OM and even-memory EM is a 18-bit memory which stores one RGB pixel data item. These memories respectively store RGB pixel data items supplied from the selector EO, and supply them to the selector WS. The selector WS supplies one of the memories M1 and M2 with the RGB pixel data items of two words respectively supplied from the odd-memory OM and even-memory EM. Each of the memories M1 and M2 has a memory capacity defined by fifty 36-bit memory areas shown in FIG. 6 and a 36-bit memory area added thereto, and stores fifty 2-word RGB pixel data items sequentially supplied from the selector WS, as one block. Each of the memories M1 and M2 stores fifty items of 2-word RGB pixel data SD sequentially supplied from the selector WS, as one block. The selector RS distributes two blocks of 2-word RGB pixel data SD, which are read out in parallel from the memories M1 and M2, to the data supply buses SDL1 and SDL2.

To control operations of the selector EO, selector WS, memories M1 and M2, and selector RS as described above, the sequence controller SC generates a control signal PS, write control signals WM1 and WM2, a write address signal WADRS, read control signals RM1 and RM2, read address signals RADRS1 and RADRS2, as well as control signals S1 and S2. The control signal PS is supplied to a selector EO. The write control signals WM1 and WM2 are supplied commonly to the selector WS, and also to the memories M1 and M2, respectively. The write address signal WADRS is supplied commonly to the memories M1 and M2. The read address signals RADRS1 and RADRS2 are respectively supplied to the memories M1 and M2. The read control signals RM1 and RM2 are respectively supplied to the memories M1 and M2. The control signals S1 and S2 are supplied in common to the selector RS.

The sequence controller SC generates write control signals in the order of WM1, WM2, WM2, WM1, WM1, WM2, WM2, . . . , in order to make the memories M1 and M2 singly perform writing operation. The selector WS selects one of the memories M1 and M2 on the basis of the write control signals as described above, and supplies the selected memory with 2-word RGB pixel data SD sequentially supplied from the odd- and evenmemories OM and EM. The write control signals WM1 and WM2 are updated each time fifty items of 2-word RGB pixel data SD are supplied. The selected memory stores 2-word RGB pixel data SD sequentially supplied from the selector WS, into a write memory area designated by the selector WS. The write address signal WADRS is updated in a cycle corresponding to the supply rate of 2-word RGB pixel data SD, and fifty items of RGB pixel data SD are respectively written into the first to fiftieth memory areas or the second to fifty first memory areas. The ranges of these write memory areas are alternately used. While thus performing writing operation, the sequence controller SC further generates read control signals RM1 and RM2 in order to make the memories M1 and M2 perform reading operation. Each of these two memories reads 2-word RGB pixel data SD from a read memory area designated by a corresponding read address signal RADRS1 or RADRS2, and supplies the 2-word RGB pixel data SD to the selector RS. The read address signals RADRS1 and RADRS2 are updated in a cycle corresponding to the half of the supply rate of 2-word RGB pixel data SD from the selector WS, and fifty items of 2-word RGB pixel data SD written in the first to fiftieth memory areas of one of the memories M1 and M2 as well as fifty items of 2-word RGB pixel data SD written in the second to fifty first memory areas are sequentially read out. The selector RS distributes two blocks of 2-word RGB pixel data SD, which are read out in parallel from the memories M1 and M2 under control of the control signals S1 and S2, to data supply buses SDL1 and SDL2 respectively corresponding to those oddnumbered driver sections and even-numbered driver sections which should be supplied with the two blocks of 2-word RGB pixel data SD. In this manner, RGB pixel data SD for each horizontal pixel array is divided into eight blocks, wherein four odd-numbered blocks are respectively supplied to driver sections XT1, XT3, XT5, and XT7 through the data supply bus SDL1, while four even-numbered blocks are respectively supplied to driver sections XT2, XT4, XT6, and XT8 through the data supply bus SDL2.

Figure 8A:
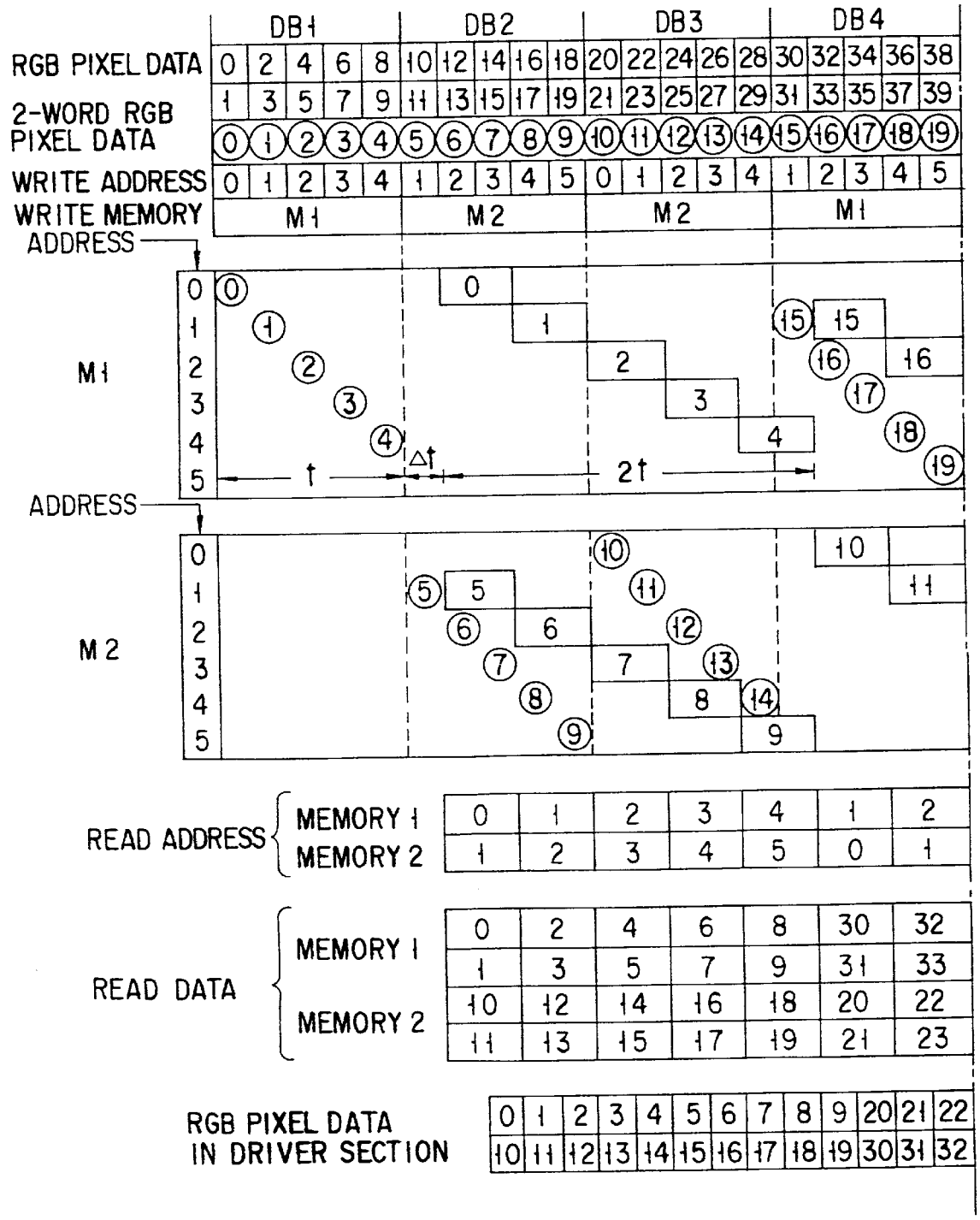
FIGS. 8A and 8B are views for explaining an operation of the flat-panel display device according to the second embodiment, controlled by the liquid crystal controller shown in FIG. 7.
Figure 8B:
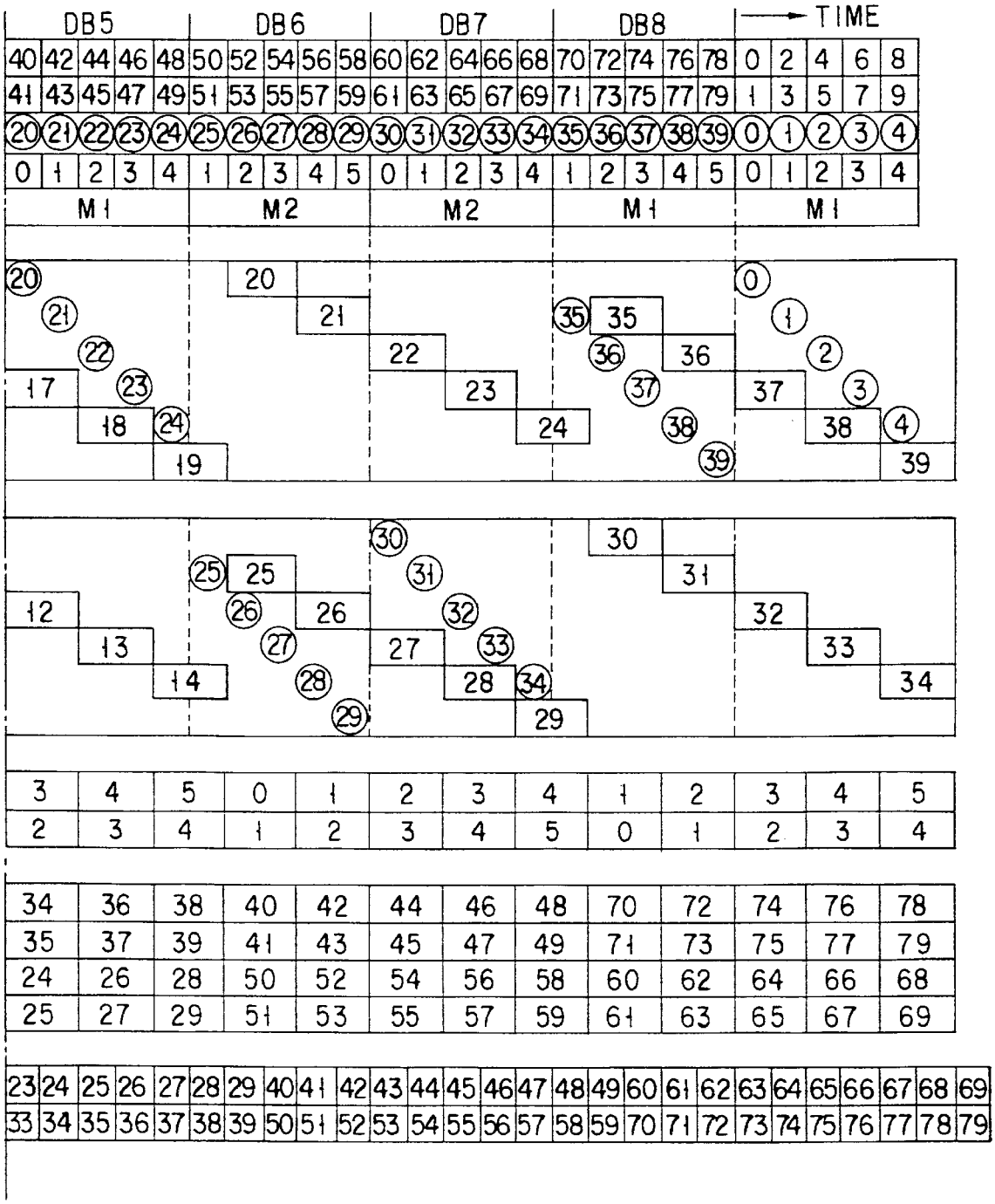

FIG. 8 shows an operation of the flat-panel display device having the structure as described above.

To make it easy to understand the operation, assume that one horizontal pixel array is formed of eighty pixels and each of the driver sections XT1, XT2, each of the memories M1 and M2 must have five 36-bit memory areas and a 36-bit memory area added thereto.

When 80 items of RGB pixel data corresponding to the pixels forming one horizontal pixel array are sequentially supplied from outside to the liquid crystal controller 16, these 80 RGB pixel data items are alternately supplied to the odd-memory OM and the even-memory EM by the selector EO. The odd-memory OM and even-memory EM respectively store the RGB pixel data items supplied from the selector EO and supplies them to the selector WS. The selector WS divides 2-word RGB pixel data items sequentially supplied from the odd- and even-memories OM and EM in units of 5 items into 8 RGB pixel-data blocks DB1 to DB8 to be assigned to the driver sections XT1, XT2, . . . , XT8. The memories M1 and M2 selectively store these RGB pixel-data blocks DB1 to DB8. Each of RGB pixel-data blocks DB1 to DB8 is written into one of the memories M1 and M2 within one block period (=t) equivalent to ⅛ of the data supply period.

Specifically, RGB pixel-data blocks DB1, DB2, DB3, DB4, DB5, DB6, DB7, and DB8 are respectively written into memories M1, M2, M2, M1, M1, M2, M2, and M1. Odd-numbered RGB pixel-data blocks DB1, DB3, DB5, and DB7 are stored in the memory areas of address 0 to 4 in the memories M1, M2, M1, and M2, and even-numbered RGB pixel-data blocks DB2, DB4, DB6, and DB8 are stored in the memory areas of address 1 to 5 in the memories M2, M1, M2, and M1.

Reading from the memories M1 and M2 is performed while writing into the memories M1 and M3 is performed as described above. In this reading, consecutive two of RGB pixel-data blocks DB1 to DB8 are read out in parallel within two block periods (=2t). Specifically, RGB pixel-data blocks DB1 and DB2 are read out in parallel from the memories M1 and M2 within first two block periods, and RGB pixel-data blocks DB3 and DB4 are read out in parallel from the memories M2 and M1 from next two block periods (=2t). RGB pixel-data blocks DB5 and DB6 are read out in parallel from the memories M1 and M2 within further next two block periods (=2t), and RGB pixel-data blocks DB7 and DB8 are read out in parallel from the memories M2 and M1 within further next two block periods (=2t).

The RGB pixel-data blocks DB1 and DB2, DB3 and DB4, DB5 and DB6, as well as DB7 and DB8 which are thus read out in parallel are distributed to the data supply buses SDL1 and SDL2 through the read selector RS. Specifically, odd-numbered pixel-data blocks DB1, DB3, DB5, and DB7 are supplied to the data supply bus SDLl connected to odd-numbered driver sections XT1, XT3, XT5, and XT7, while even-numbered RGB pixel-data blocks DB2, DB4, DB6, and DB8 are supplied to the data supply bus SDL2 connected to even-numbered driver sections XT2, XT4, XT6, and XT8.

Meanwhile, the sequence controller controls the data distribution circuit DST such that before completion of writing of consecutive two RGB pixel-data blocks, parallel reading of these two RGB pixel-data blocks is started, and writing of each RGB pixel data is not overtaken by reading thereof.

For example, RGB pixel-data block DB1 is written in the memory M1 in the first block period, and the RGB pixel-data block DB2 is written in the memory M2 in the second block period. These RGB pixel-data blocks DB1 and DB2 are read out from the memories M1 and M2 in parallel in the second and third block periods. The memory M2 is used for writing and reading RGB pixel-data block DB2 in the second block period. However, start of reading is delayed by a period of $\Delta$ t required for storing 2-word RGB pixel data. Therefore, after writing first 2-word RGB pixel data into a memory area of address 1, the 2-word RGB pixel data can be read.

From the memory M2 there will be read the RBG pixel data block DB2 during the third block period. Into the memory M2 there will be written the RGB pixel data block DB3. Nonetheless, the last two words of the block DB2 can be read from the memory area of the address 5, and the last two words of the block DB3 can be written into the memory area of address 4. This is because the memory areas in which to store the RGB pixel data block DB2 entirely overlaps the memory areas in which to store the RGB pixel data block DB3, except for one memory area.

In the screen of the actual display, each horizontal pixel array consists of 2400 pixels, and the block drivers XT1, XT2, . . . , XT8 drive 300 signal lines each. The memories M1 and M2 therefore has one additional 36-bit memory area each. The operating mode of the actual display is basically the same as the first embodiment.

Hence, even if each of the memories M1 and M2 has a storage capacity of 50 words×36 bits, it is possible to write 2-word RGB pixel data for one horizontal pixel array into the memory M1 or M2, in the form of 50 blocks, at the data supply rate, and to read the 2-word RGB pixel data from both memories M1 and M2 at half the data supply rate, and to distribute the data thus read, to two data supply lines SDL1 and SDL2. More precisely, the odd-numbered RGB pixel data blocks DB1, DB3, . . . , DB7 are supplied to the data supply line SLD1 connected to the odd-numbered block drivers XT1, XT3, . . . , XT6, respectively, and the even-numbered RGB pixel data blocks DB2, DB4, . . . , DB8 are supplied to the data supply line SLD2 connected to the even-numbered block drivers XT2, XT4, . . . , XT8, respectively. Thus, the RGB pixel data blocks DB1 and DB2 are simultaneously processed by the RGB pixel data block drivers XT1 and XT2; the RGB pixel data blocks DB3 and DB4 are simultaneously processed by the RGB pixel data block drivers XT3 and XT4; the RGB pixel data blocks DB5 and DB6 are simultaneously processed by the RGB pixel data block drivers XT5 and XT6; and the RGB pixel data blocks DB7 and DB8 are simultaneously processed by the RGB pixel data block drivers XT7 and XT8.

In the second embodiment, the RGB pixel data is divided into pixel data blocks, each equivalent to the number of pixels forming one pixel block. The pixel data blocks are alternately written into the memory M1 and the memory M2. While new pixel data blocks are being written into the memories M1 and M1 in this way, the pixel data blocks already stored in the memories M1 and M2 are simultaneously read out. The pixel data blocks read from the memory M1 are supplied to the data supply line SDL1, whereas the pixel data blocks read from the memory M2 are supplied to the data supply line SDL2. Hence, the total storage capacity of the memories M1 and M2 is far less than half the storage capacity required to store all pixel data for one horizontal pixel array. The total storage capacity does not largely depend on the number of pixel data items for one horizontal pixel array or the word length of each pixel data item. This makes it possible to increase the data items and the word length, without increasing the storage capacity of the memories M1 and M2. As a result, the manufacturing cost of the flat panel display can be prevented from increasing, despite the technique of driving the horizontal pixel arrays in units of blocks.

Although the memories M1 and M2 need to have one additional memory area each, the memory M3 shown in FIG. 4 can be dispensed with.

The selector EO, the odd-memory OM and the even-memory EM may be dispensed with if the speed of the block drivers XT1 to XT8 need not be reduced further. In this case, each memory area of the memories M1 and M2 is a 18-bit area for storing an RGB pixel data item.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A flat-panel display device comprising:

a display panel having a plurality of pixels arrayed in a matrix, the pixels in each row forming one horizontal pixel array;

a plurality of block driving circuits arranged in series to divide pixels in each horizontal pixel array to a plurality of pixel blocks, for driving the pixel blocks, respectively;

M data supply buses each connected to at least one of block driving circuits; and control means for distributing pixel data sequentially supplied from outside to said data supply buses;

wherein the control means includes:

a distributing circuit having a plurality of memory sections each of which stores items of pixel data for one pixel block and is capable of reading from one area while writing to another area, a total memory capacity of said memory sections being smaller than a memory capacity required for storing all items of pixel data for one horizontal pixel array, and a control circuit for performing a control of dividing pixel data items sequentially supplied from outside into pixel-data blocks each consisting of the same number of pixel data items, equivalent to the number of pixels forming one pixel block, sequentially writing M pixel-data blocks in M memory sections, reading M pixel-data blocks stored in said M memory sections in parallel while writing is performed, and supplying the M pixel-data blocks to corresponding ones of said data supply buses.

2. A flat-panel display device according to claim 1, wherein a total memory capacity of the plurality of memory sections is set to be smaller than half of a memory capacity required for storing pixel data items for one horizontal pixel array.

3. A flat-panel display device according to claim 1, wherein said M data supply buses include first and second data supply buses, and the number of block driving circuits is set to an integer multiple of 2.

4. A flat-panel display device according to claim 3, wherein said distributing circuit includes first, second, and third memory sections each of which has a memory capacity required for storing pixel data items in number equivalent to the number of pixels forming one pixel block, and which are selected one by one to write each pixel-data block and selected two by two to read consecutive two pixel-data blocks in parallel, said control circuit includes a sequence controller for performing a control of writing each pixel-data block in one of the first to third memory sections within a predetermined period, and reading consecutive two pixel-data blocks stored in two of said first to third memory sections in parallel within a period twice longer than said predetermined period while writing is performed, said control being performed without overlapping a writing area and a reading area.

5. A flat-panel display device according to claim 4, wherein said each pixel data is color pixel data representing a plurality of color components, each block driving circuit is constructed to drive pixels in number equal to the number of said color components in accordance with color pixel data.

6. A flat-panel display device according to claim 4, wherein said distributing circuit includes converting means for converting pixel data items supplied from outside in units of two items into 2-word pixel data, each area of the memory sections has a word length which is twice the number of bits of one pixel data item to store 2-word pixel data supplied from said converting means.

7. A flat-panel display device according to claim 3, wherein said distributing circuit includes first and second memory sections each of which has a memory capacity capable of storing at least one more pixel data item than pixel data items in number equivalent to the number of pixels forming one pixel block, and which are selected one by one to write each pixel-data block and selected together to read consecutive two pixel-data blocks in parallel, said control circuit includes a sequence controller for performing a control of writing each pixel-data block in one of the first and second memory sections within a predetermined period, and reading consecutive two pixel-data blocks stored in said first and second memory sections in parallel within a period twice longer than said predetermined period while writing is performed, said control being performed without overlapping a writing area and a reading area.

8. A flat-panel display device according to claim 7, wherein said each pixel data is color pixel data representing a plurality of color components, each block driving circuit is constructed to drive pixels in number equal to the number of said color components in accordance with color pixel data.

9. A flat-panel display device according to claim 7, wherein said distributing circuit includes converting means for converting pixel data items supplied from outside in units of two items into 2-word pixel data, each area of the memory sections has a word length which is twice the number of bits of one pixel data item to store 2-word pixel data supplied from said converting means.

10. A flat-panel display device comprising:

a display panel having a plurality of pixels arrayed in a matrix, the pixels in each row forming one horizontal pixel array;

a first and second block driving circuits for driving first and second pixel blocks obtained by dividing pixels in each horizontal pixel array, respectively;

control means for distributing pixel data for one horizontal pixel array to said first and second block driving circuits;

wherein the control means includes:

memory means having a plurality of memory areas whose total memory capacity is smaller than a memory capacity corresponding to the number of pixel data items for one horizontal pixel array, and a control circuit for selecting a writing area and a reading area in a predetermined pattern to write pixel data sequentially supplied, read pixel data items to be distributed to said first and second block driving circuits, and enable an area storing pixel data already read to be available for writing.

11. A flat-panel display device comprising:

a display panel having a plurality of pixels arrayed in a matrix, the pixels in each row forming one horizontal pixel array;

M block driving circuits for driving M pixel blocks obtained by dividing pixels in each horizontal pixel array, respectively;

control means for distributing pixel data for one horizontal pixel array to said M block driving circuits;

wherein the control means includes:

memory means having a plurality of memory areas whose total memory capacity is smaller than a memory capacity corresponding to the number of pixel data items for one horizontal pixel array, and a control circuit for selecting a writing area and a reading area in a predetermined pattern to write pixel data sequentially supplied, read pixel data items to be distributed to said M block driving circuits, and enable an area storing pixel data already read to be available for writing.

12. A method of driving a flat-panel display device which comprises a display panel having a plurality of pixels arrayed in a matrix, the pixels in each row forming one horizontal pixel array, a plurality of block driving circuits arranged in series to divide pixels in each horizontal pixel array to a plurality of pixel blocks, for driving the pixel blocks, respectively, M data supply buses each connected to at least one of the block driving circuit, and control means for distributing pixel data sequentially supplied from outside to the data buses, the control means including a distributing circuit having a plurality of memory sections each of which stores items of pixel data for one pixel block and is capable of reading from one area while writing to another area, and a total memory capacity of the memory sections being smaller than a memory capacity required for storing all items of pixel data for one horizontal pixel array, comprising:

a first step of dividing pixel data items sequentially supplied from outside into pixel-data blocks each consisting of the same number of pixel data items, equivalent to the number of pixels forming one pixel block, a second step of sequentially writing M pixel-data blocks in M memory sections and reading M pixel-data blocks stored in said M memory sections in parallel while writing is performed, and a third step of supplying the M pixel-data blocks to corresponding ones of the data supply buses.

13. A method of driving a flat-panel display device according to claim 12, wherein a total memory capacity of the plurality of memory sections is set to be smaller than half of a memory capacity required for storing pixel data items for one horizontal pixel array.

14. A method of driving a flat-panel display device according to claim 12, wherein said M data supply buses include first and second data supply buses, and the number of block driving circuits is set to an integer multiple of 2.

15. A method of driving a flat-panel display device according to claim 14, wherein said distributing circuit includes first, second, and third memory sections each of which has a memory capacity required for storing pixel data items in number equivalent to the number of pixels forming one pixel block, and which are selected one by one to write each pixel-data block and selected two by two to read consecutive two pixel-data blocks in parallel, said second step includes a substep of performing a control of writing each pixel-data block in one of the first to third memory sections within a predetermined period, and reading consecutive two pixel-data blocks stored in two of said first to third memory sections in parallel within a period twice longer than said predetermined period while writing is performed, said control being performed without overlapping a writing area and a reading area.

16. A method of driving a flat-panel display device according to claim 15, wherein said each pixel data is color pixel data representing a plurality of color components, each block driving circuit is constructed to drive pixels in number equal to the number of said color components in accordance with color pixel data.

17. A method of driving a flat-panel display device according to claim 15, wherein said distributing circuit includes converting means for converting pixel data items supplied from outside in units of two items into 2-word pixel data, each area of the memory sections has a word length which is twice the number of bits of one pixel data item to store 2-word pixel data supplied from said converting means.

18. A method of driving a flat-panel display device according to claim 14, wherein said distributing circuit includes first and second memory sections each of which has a memory capacity capable of storing at least one more pixel data item than pixel data items in number equivalent to the number of pixels forming one pixel block, and which are selected one by one to write each pixel-data block and selected together to read consecutive two pixel-data blocks in parallel, said second step includes a substep of performing a control of writing each pixel-data block in one of the first and second memory sections within a predetermined period, and reading consecutive two pixel-data blocks stored in said first and second memory sections in parallel within a period twice longer than said predetermined period while writing is performed, said control being performed without overlapping a writing area and a reading area.

19. A method driving a flat-panel display device according to claim 18, wherein said each pixel data is color pixel data representing a plurality of color components, each block driving circuit is constructed to drive pixels in number equal to the number of said color components in accordance with color pixel data.

20. A method of driving a flat-panel display device according to claim 18, wherein said distributing circuit includes converting means for converting pixel data items supplied from outside in units of two items into 2-word pixel data, each area of the memory sections has a word length which is twice the number of bits of one pixel data item to store 2-word pixel data supplied from said converting means.

* * * * *